US010767440B2

(12) United States Patent
Stair et al.

(10) Patent No.: US 10,767,440 B2
(45) Date of Patent: Sep. 8, 2020

(54) WIPER DART WITH REINFORCED DRIVE ELEMENT

(71) Applicant: Halliburton Energy Services, Inc., Houston, TX (US)

(72) Inventors: Todd Anthony Stair, Spring, TX (US); Gary Joe Makowiecki, Spring, TX (US); Carlos Alejandro Valdez, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 175 days.

(21) Appl. No.: 16/091,426

(22) PCT Filed: May 16, 2016

(86) PCT No.: PCT/US2016/032632

§ 371 (c)(1),
(2) Date: Oct. 4, 2018

(87) PCT Pub. No.: WO2017/200513

PCT Pub. Date: Nov. 23, 2017

(65) Prior Publication Data

US 2019/0128087 A1 May 2, 2019

(51) Int. Cl.

| | |
|---|---|
| ***E21B 33/126*** | (2006.01) |
| ***E21B 37/10*** | (2006.01) |
| ***E21B 33/16*** | (2006.01) |
| *E21B 33/14* | (2006.01) |

(52) U.S. Cl.
CPC ..... *E21B 33/126* (2013.01); *E21B 33/16* (2013.01); *E21B 33/14* (2013.01); *E21B 37/10* (2013.01)

(58) Field of Classification Search
CPC ..... E21B 33/08; E21B 33/126; E21B 33/14; E21B 33/16; E21B 33/165; E21B 37/10
See application file for complete search history.

(56) References Cited

U.S. PATENT DOCUMENTS

| | | | |
|---|---|---|---|
| 274,061 | A | 3/1883 | Voglesong |
| 1,563,162 | A | 11/1925 | George |
| 2,674,315 | A | 4/1954 | Brown |

(Continued)

FOREIGN PATENT DOCUMENTS

CA 2975090 A1 * 9/2016 ..... E21B 34/14

OTHER PUBLICATIONS

CN Application Serial No. 201680083353.X; First Office Action; dated Dec. 10, 2019, 17 pages.

(Continued)

*Primary Examiner* — Jennifer H Gay
(74) *Attorney, Agent, or Firm* — Gilliam IP PLLC

(57) ABSTRACT

A wiper dart includes one or more wiper elements disposed about a mandrel, each wiper element comprising a wiper cup that extends radially outward and rearwardly relative to the mandrel, and a nose assembly coupled to the mandrel. A drive element is disposed about the mandrel and includes a shoe and a cup coupled to the shoe. The cup extends radially outward and rearwardly from the shoe and exhibits a maximum diameter less than or equal to a maximum diameter of the one or more wiper elements, and the shoe provides at least one of axial and radial support to the cup.

20 Claims, 3 Drawing Sheets

(56) References Cited

U.S. PATENT DOCUMENTS

| | | | | | |
|---|---|---|---|---|---|
| 3,006,415 | A * | 10/1961 | Burns et al. | E21B 33/16 | 166/156 |
| 4,378,838 | A * | 4/1983 | Ogden | E21B 33/16 | 166/153 |
| 4,671,358 | A * | 6/1987 | Lindsey, Jr. | E21B 34/14 | 166/154 |
| 4,756,365 | A * | 7/1988 | Schneider | E21B 23/10 | 166/153 |
| 8,276,665 | B2 * | 10/2012 | Webb | E21B 33/16 | 166/285 |
| 2004/0065435 | A1 | 4/2004 | Tessier et al. | | |
| 2008/0006403 | A1 * | 1/2008 | Benzie | E21B 43/103 | 166/285 |
| 2009/0250217 | A1 * | 10/2009 | Webb | E21B 33/16 | 166/285 |
| 2013/0105144 | A1 | 5/2013 | Jordan et al. | | |
| 2014/0224807 | A1 * | 8/2014 | Ramon | E21B 33/16 | 220/359.1 |
| 2018/0023362 | A1 * | 1/2018 | Makowiecki | E21B 34/14 | 166/374 |
| 2018/0135378 | A1 * | 5/2018 | Budde | E21B 43/10 | |
| 2019/0128087 | A1 * | 5/2019 | Stair | E21B 33/16 | |

OTHER PUBLICATIONS

RU Application Serial No. 2018132196; Office Action; dated May 22, 2019, 7 pages.

PCT Application Serial No. PCT/US2016/032632, International Search Report, dated Feb. 15, 2017, 3 pages.

PCT Application Serial No. PCT/US2016/032632, International Written Opinion, dated Feb. 15, 2017, 10 pages.

Russian Application Serial No. 2018132196; Decision to Grant; dated May 18, 2020, 15 pages.

* cited by examiner

WIPER DART WITH REINFORCED DRIVE ELEMENT

BACKGROUND

In the oil and gas industry, wellbores are commonly completed by cementing wellbore liner (e.g., casing, liner, etc.) into the drilled borehole. In some cementation operations, a wiper dart (alternately referred to as a dart, a wiper plug, a cementing plug, a drill pipe dart, and a drill pipe wiping dart) is pumped downhole to hydraulically force a cement slurry through the wellbore liner and out into the open wellbore. The cement slurry exits the wellbore liner and flows into an annulus defined between the wellbore liner and the wellbore wall where it eventually cures to provide a cement sheath that secures the wellbore liner within the wellbore.

Wiper darts are typically pumped downhole through a work string extended into the wellbore, including multiple lengths of drill pipe or other tubulars connected end to end. Wiper darts commonly have one or more wiper elements or "cups" that flare radially outward to sealingly engage the inner diameter of the work string. The wiper elements help generate a pressure differential across the wiper dart by preventing fluid flow across the wiper dart as it is pumped downhole. Moreover, the wiper elements also serve to "wipe" the inner wall of the work string and thereby substantially remove the cement slurry from the work string.

Wiper darts are often required to pass through varying inner diameters as they are pumped downhole. For instance, multiple tubing sizes are commonly used within the same work string, and each tubing size can exhibit a different inner diameter. Moreover, wiper darts are also often required to pass through minimum restrictions provided by various downhole tools, such as a cement head, safety valves, a crossover tool, diverter tools, liner hangers, liner plug assemblies, and other conventional wellbore cementing tools. Accordingly, not only does a wiper dart have to effectively seal and wipe a variety of inner diameters as it is pumped downhole, it must also successfully pass through various minimum restrictions while performing these vital functions. Such small inner diameters or restrictions are collectively referred to herein as "reduced diameter restrictions." Due to the immense amount of friction caused by the wiper elements as they pass through reduced diameter restrictions, the wiper dart can become stuck and may not reach its final destination. As can be appreciated, retrieving a stuck wiper dart can be a costly and time-consuming operation.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to downhole tools used in the oil and gas industry and, more particularly, to wiper darts that include a reinforced drive element designed for operation through minimum and severe restrictions in a work string or wellbore liner.

Embodiments of the present disclosure describe a wiper dart that includes a drive element designed to help the wiper dart traverse reduced diameter sections encountered in a work string or a wellbore liner, which may help prevent the wiper dart from becoming stuck downhole. The wiper darts described herein include one or more wiper elements disposed about a mandrel, where each wiper element comprises a wiper cup that extends radially outward and rearwardly relative to the mandrel. Unlike traditional drive elements, which fail to include any form of rigid mechanical support to prevent extrusion, inversion, or bypass, the drive elements described herein include a rigid shoe and a cup coupled to the shoe. The cup extends radially outward and rearwardly from the shoe and exhibits a maximum diameter less than or equal to a maximum diameter of the wiper elements. In some embodiments, however, the cup may alternatively exhibit a maximum diameter greater than at least one of the wiper elements. Moreover, the shoe is designed to provide at least one of axial and radial support to the cup during operation. Preventing the wiper dart from becoming stuck in the work string or other portions of a wellbore is critical for cementing operations, for example.

Figure 1:
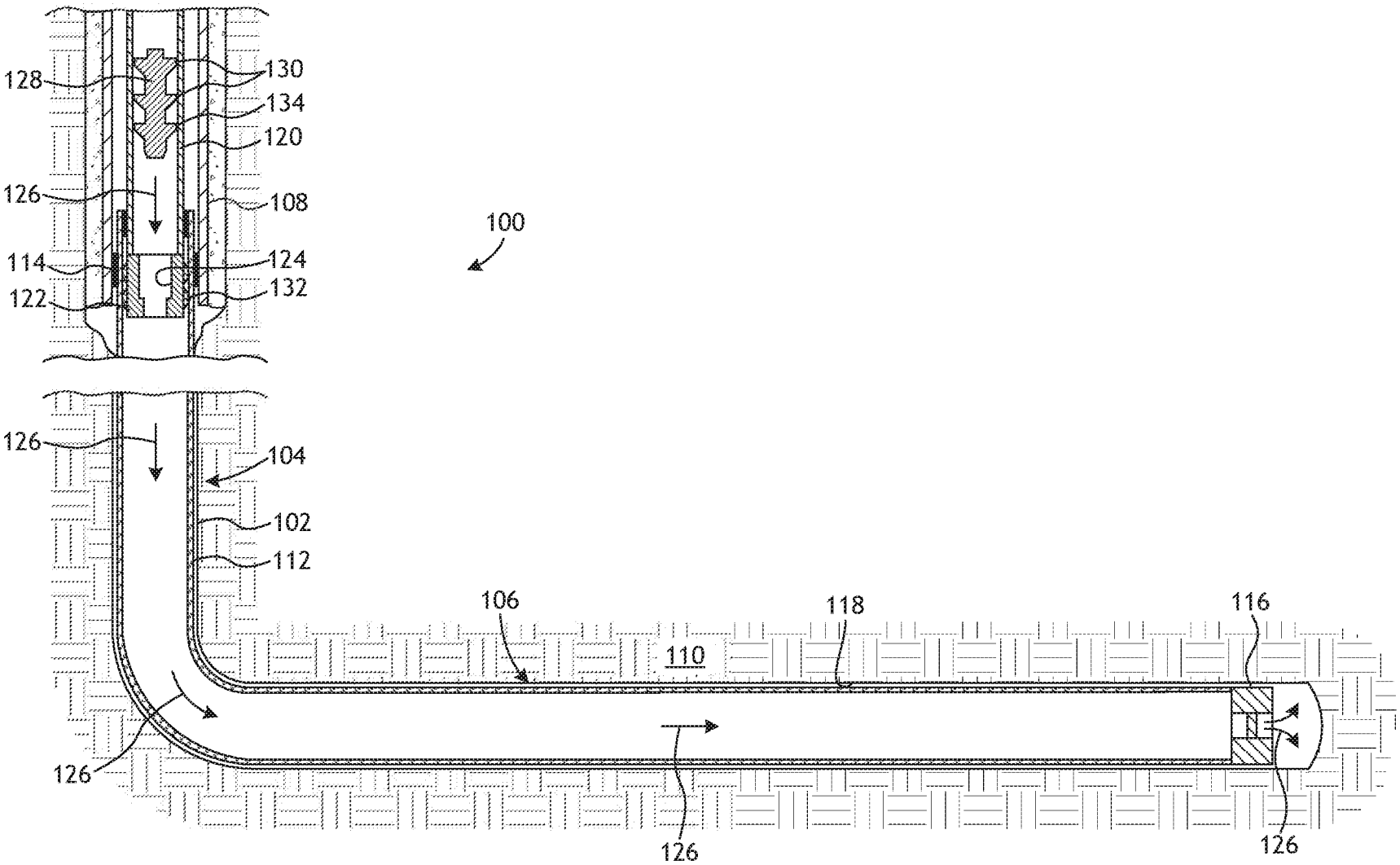
FIG. 1 is a well system that may employ the principles of the present disclosure.

FIG. 1 is a well system 100 that may employ the principles of the present disclosure, according to one or more embodiments. As depicted, the well system 100 includes a wellbore 102 that extends through various earth strata and has a substantially vertical section 104 that transitions into a substantially horizontal section 106. The upper portion of the vertical section 104 may have a string of casing 108 cemented therein, and the horizontal section 106 may extend through a hydrocarbon-bearing subterranean formation 110. A liner 112 is coupled to and otherwise "hung off" the distal end of the casing 108 at a liner hanger 114 and extends downhole from the casing 108 into the horizontal section 106. The casing 108 and the liner 112 may each be referred to herein as "wellbore liners."

A float shoe 116 is coupled to the distal end of the liner 112 and allows cement and other fluids to be discharged from the liner 112 into an annulus 118 defined between the liner 112 and the inner wall of the wellbore 102. The float shoe 116 can be equipped with one or more floats or check valve devices that permit fluid flow out of the liner 112 while simultaneously preventing fluids from re-entering the liner 112 from the annulus 118.

Fluids can be supplied to the liner 112 and the annulus 118 via a work string 120 that is insertable into the liner 112 at its uphole end. In some cementing applications, a liner wiper 122 (alternately referred to as a "cement plug") may be releasably coupled to the lower end of the work string 120. The liner wiper 122 has a flow passage 124 that extends therethrough to facilitate fluid communication between the work string 120 and the liner 112 once the work string 120 is properly coupled to the liner 112.

In an example cementing operation, a cement slurry 126 is pumped down the work string 120 and into the liner 112 after passing through the flow passage 124 of the liner wiper 122. After circulating through the liner 112, the cement slurry 126 is discharged into the open wellbore 102 via the float shoe 116. To promote the progression of the cement slurry 126 through the work string 120 and the liner 112, a wiper dart 128 can be introduced into the work string 120 and pumped downhole. The wiper dart 128 may alternately be referred to as a pump down plug or a wiper plug. Generally, a pressurized fluid is supplied on its uphole side to hydraulically propel the wiper dart 128 through the work string 120, which displaces the cement slurry 126 into the liner 112 and the annulus 118 as the wiper dart 128 progresses through the work string 120.

The wiper dart 128 is configured to prevent fluid communication across the wiper dart 128 in both the uphole and downhole directions. To accomplish this, the wiper dart 128 includes one or more wiper elements 130 (two shown) extending from a central body to sealingly engage the inner wall of the work string 120. The wiper elements 130 may be formed from any suitable material, such as a resilient elastomeric material, and may take any shape, such as the shape of a rearwardly extending cup. The sealed engagement of the wiper elements 130 against the inner diameter of the work string 120 allows the pressurized fluid to propel the wiper dart 128 downhole while simultaneously urging the cement slurry 126 and other fluids (e.g., a spacer fluid separating the cement slurry 126 and the wiper dart 128) in the downhole direction. As the wiper dart 128 advances within the work string 120, the wiper elements 130 wipe the inner diameter of the work string 120 and thereby clean the work string 120 of residue cement slurry 126.

The wiper dart 128 is configured to be received by and sealingly engage the liner wiper 122, and thereby obstruct the flow passage 124. Once the wiper dart 128 is received by the liner wiper 122, increasing the fluid pressure within the work string 120 releases the liner wiper 122 and allows the liner wiper 122, together with the wiper dart 128, to be propelled downhole into the liner 112. The liner wiper 122 includes wiping elements 132 configured to sealingly engage the inner wall of the liner 112 and operate similar to the wiping elements 130 of the wiper dart 128, but with respect to the liner 112. As the liner wiper 122 and the wiper dart 128 jointly advance within the liner 112, the wiper elements 132 wipe (clean) the inner wall of the liner 112 and the cement slurry 126 (and/or other fluids) is pushed through the liner 112 and into the annulus 118 via the float shoe 116.

Upon passing through a reduced diameter downhole tool or section of the work string 120, the wiper elements 130 will radially contract to enable the wiper dart 128 to traverse such areas. Wrinkles may form about the outer periphery of the wiper elements 130 as they radially contract, which creates leak paths across the wiper dart 128 that decrease the ability of the wiper dart 128 to generate the pressure differential required to hydraulically propel the wiper dart 128 downhole. In other cases, upon passing through a reduced diameter downhole tool or section of the work string 120, the hydraulic pressure may force the wiper elements 130 to invert in the downhole direction (i.e., turn itself inside out), which creates much larger leak paths across the wiper dart 128 and reduces its efficiency.

According to embodiments of the present disclosure, the wiper dart 128 may further include a drive element 134 used to help the wiper dart 128 pass through small inner diameters or restrictions within the work string 120 or other downhole tools included in the well system 100. Such small inner diameters or restrictions within the work string 120 or downhole tools are collectively referred to herein as "reduced diameter restrictions." The drive element 134 may be axially spaced from the wiper elements 130 along the body of the wiper dart 128 and may exhibit a smaller diameter as compared to the wiper elements 130. Furthermore, the geometry of the drive element 134 may be designed to withstand increased hydraulic forces required to propel the wiper dart 128 through reduced diameter restrictions. The drive element 134 may be configured to combine the differential pressure capacity and rigid mechanical support of a packer cup, for example, with the flexibility of conventional wiper elements 130.

While FIG. 1 depicts the liner 112 as being extended into the horizontal section 106 of the wellbore 102, those skilled in the art will readily recognize that the liner 112 is equally well suited for use solely or partially in the vertical section 106 or a deviated or slanted portion between vertical section 104 and the horizontal section 106. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
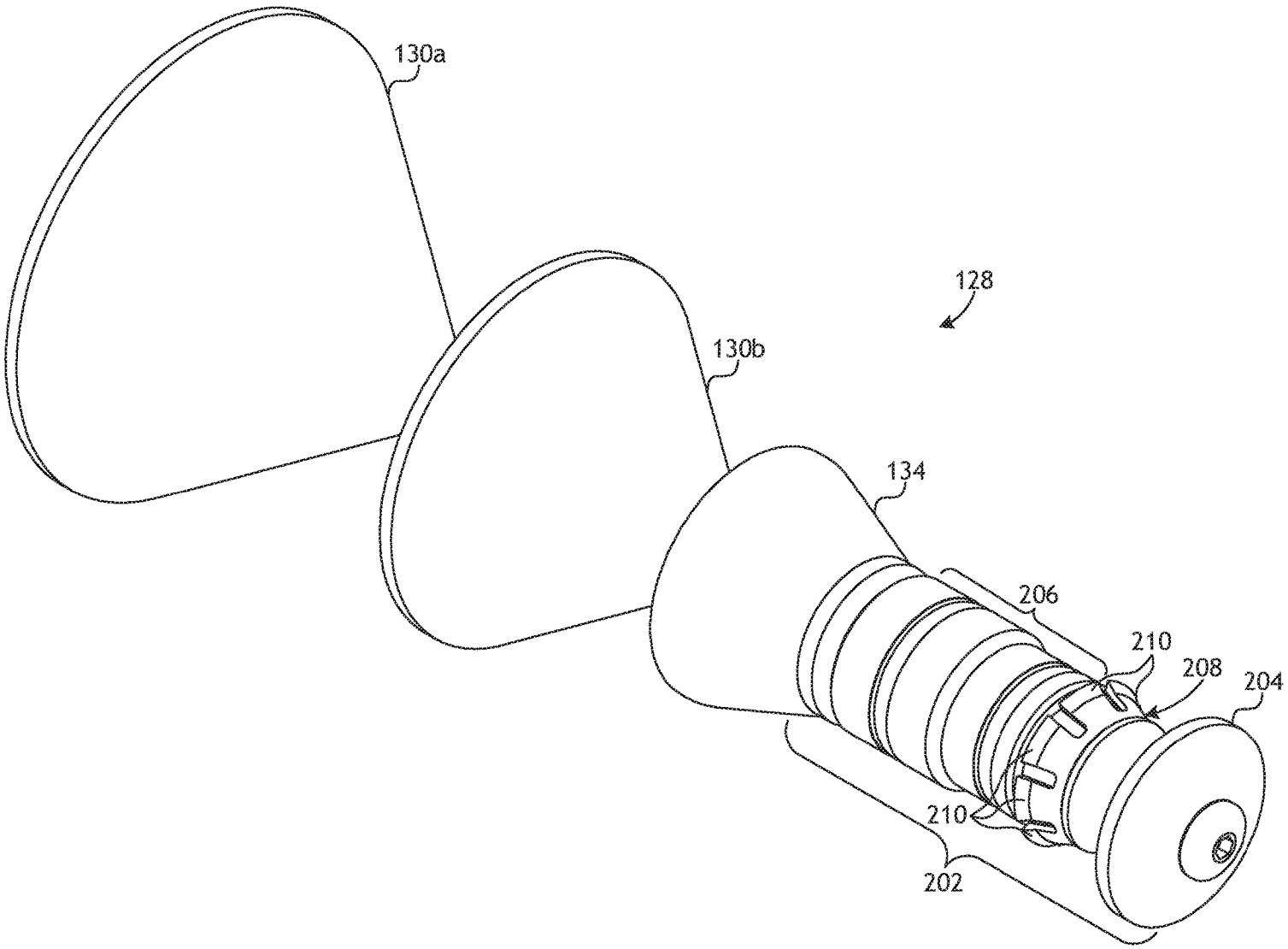
FIG. 2 is an isometric view of an example embodiment of the wiper dart of FIG. 1.

FIG. 2 is an isometric view of an example embodiment of the wiper dart 128 of FIG. 1, according to one or more embodiments. As illustrated, the wiper dart 128 includes two wiper elements 130 axially spaced from each other and referred to in FIG. 2 as a first wiper element 130*a* and a second wiper element 130*b*. While two wiper elements 130*a,b* are depicted in FIG. 2, it will be appreciated that more or less than two wiper elements 130*a,b* may be included in the wiper dart 128, without departing from the scope of the disclosure. As indicated above, the wiper elements 130*a,b* may be made of, for example, a resilient elastomeric material that allows the wiper elements 130*a,b* to flex radially inward upon encountering a reduced diameter restriction.

The wiper dart 128 also includes a nose assembly 202, which may include a front cup 204, a sealing section 206, and a coupling member 208. The front cup 204 may be positioned at the front or leading end of the nose assembly 202 and extends radially outward from the body of the wiper dart 128. The front cup 204 may help maintain the wiper dart 128 generally centered within the work string 112 (FIG. 1) or other downhole tubular as the wiper dart 128 advances downhole. Moreover, similar to the wiper elements 130*a,b*, the front cup 204 may be made of a resilient elastomeric material that allows the front cup 204 to flex when needed.

The sealing section 206 may be configured to be received within and sealingly engage a receiving section of a downhole tool. In some embodiments, for example, the sealing section 206 may be configured to be received within and sealingly engage the flow passage 124 (FIG. 1) of the liner wiper 122 (FIG. 1), but could alternatively be configured to sealingly engage the receiving section of another type of downhole tool, without departing from the scope of the disclosure. To help facilitate a sealed engagement with the downhole tool, the sealing section 206 may be coated with an elastomeric compound and/or fitted with one or more seals. Once the sealing section 206 is properly received within a corresponding receiving section of a downhole tool, fluid communication through the downhole tool may be substantially prevented.

The coupling member 208 is depicted in FIG. 2 as interposing the front cup 204 and the sealing section 106, but could alternatively be placed at other locations along the length of the nose assembly 202, without departing from the scope of the disclosure. The coupling member 208 may be configured to couple the wiper dart 128 to a downhole tool. Securing the wiper dart 128 to a downhole tool with the coupling member 208 allows the wiper dart 128 and the corresponding downhole tool to subsequently move as a single unit. In some embodiments, for example, the coupling member 208 may be configured to engage a receiving member provided by the liner wiper 122 (FIG. 1) (e.g., within the flow passage 124) and thereby secure the wiper dart 128 to the liner wiper 122.

The coupling member 208 may comprise any self-energized device designed to engage and latch into a corresponding receiving member of a downhole tool. In the illustrated embodiment, for example, the coupling member 208 may comprise a collet-type latch ring having a plurality of axially extending collet fingers 210 that protrude radially outward. The collet fingers 210 may be configured to locate and engage a corresponding collet profile provided by the receiving member of a downhole tool. In other embodiments, however, the coupling member 208 may comprise a "C" ring or snap ring that can be attached to the nose assembly 202 by expanding the ring over the outer diameter of the nose assembly 202 to lodge in a corresponding groove. Upon locating the receiving member of a downhole tool, the ring may snap or expand into engagement therewith and thereby secure the wiper dart 128 to the downhole tool. In yet other embodiments, the coupling member 208 may comprise one or more uniquely shaped keys (not shown) configured to selectively engage a matching uniquely shaped receiving profile in the receiving member of a downhole tool.

The drive element 134 is also depicted in FIG. 2 as forming part of the wiper dart 128. In the illustrated embodiment, the drive element 134 is positioned to axially interpose the wiper elements 130*a,b* and the nose assembly 202. In other embodiments, however, the drive element 134 may be positioned at other locations along the axial length of the wiper dart 128, such as between the wiper elements 130*a,b* or alternatively on the opposing uphole end of the wiper elements 130*a,b*, without departing from the scope of the disclosure.

Figure 3:
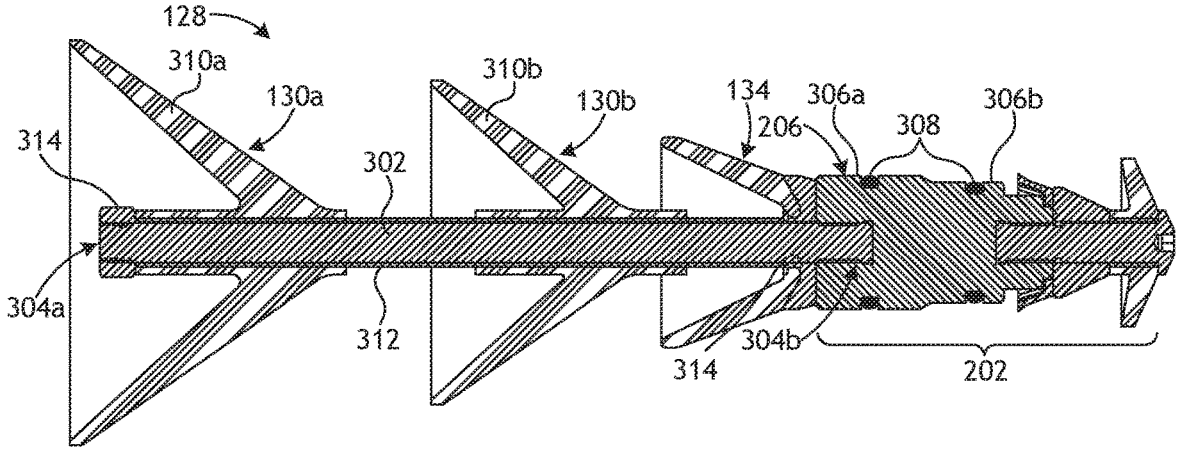
FIG. 3 is a cross-sectional side view of the wiper dart of FIG. 2.

FIG. 3 is a cross-sectional side view of the wiper dart 128 of FIG. 2. As illustrated, the wiper dart 128 includes an elongate mandrel 302 having a first end 304*a* and a second end 304*b* opposite the first end 304*a*. The nose assembly 202 may be secured to the mandrel 302 at the second end 304*b*, such as by a threaded engagement, through the use of one or more mechanical fasteners (e.g., screws, bolts, snap rings, pins, etc.), or via an interference fit.

As illustrated, the sealing section 206 may exhibit a seal profile configured to mate with a corresponding profile of a receiving section of a downhole tool. More specifically, the sealing section 206 may include a first portion 306*a* and a second portion 306*b*, where the first portion 306*a* exhibits a larger diameter than the second portion 306*b*. One or both of the first and second portions 306*a,b* may be configured to be received by the profile provided by the receiving section of the downhole tool. In at least one embodiment, the flow passage 124 (FIG. 1) of the liner wiper 122 of FIG. 1 may provide a receiving profile configured to receive and seal the first and second portions 306*a,b*.

The sealing section 206 may also include one or more seal elements 308 (two shown) configured to sealingly engage a receiving section of a downhole tool. In the illustrated embodiment, individual seal elements 308 may be positioned on each of the first and second portions 306*a,b*, but could alternatively be positioned in other arrangements (e.g., more than one seal element 308 positioned on one or both of the first and second portions 306*a,b*), without departing from the scope of the disclosure. The seal elements 308 may be made of a variety of materials including, but not limited to, an elastomeric material, a rubber, a metal, a composite, a ceramic, any derivative thereof, and any combination thereof. In some embodiments, as illustrated, the seal elements 308 may comprise O-rings or the like. In other embodiments, however, the seal elements 308 may comprise a set of v-rings or CHEVRON® packing rings, or another appropriate seal configuration (e.g., seals that are round, v-shaped, u-shaped, square, oval, t-shaped, etc.), as generally known to those skilled in the art. One or more of the seal elements 308 may alternatively comprise a molded rubber or elastomeric seal, a metal-to-metal seal (e.g., O-ring, crush ring, crevice ring, up stop piston type, down stop piston type, etc.), or any combination of the foregoing.

As illustrated, the first and second wiper elements 130*a,b* each include or otherwise provide a wiper cup 310*a* and 310*b*, respectively, formed in a generally frustoconical shape. Each wiper cup 310*a,b* extends radially outward and rearwardly and is, therefore, open toward the trailing end of the wiper dart 128; e.g., toward the uphole or back end. The first and second wiper elements 130*a,b* may be axially offset from each other along the length of the mandrel 302 and secured to the mandrel 302 by various means or devices. In some embodiments, for example, one or both of the wiper elements 130*a,b* may be coupled directly to the outer surface of the mandrel 302, such as being molded directly to the outer surface of the mandrel 302 or being secured thereto using one or more mechanical fasteners (e.g., screws, bolts, snap rings, pins, etc.), or via a shrink or interference fit.

In other embodiments, however, one or both of the wiper elements 130*a,b* may be molded to or otherwise coupled to an insert 312 and the insert 312 may be sized to receive and otherwise extend over the mandrel 302. In such embodiments, the insert 312 may be secured to the mandrel 302 through a shrink fit or alternatively (or addition thereto) with a threaded nut 314 coupled to the mandrel 302 at the first end 304*a*.

The drive element 134 may define or otherwise provide a central orifice 316 configured to receive the mandrel 302 so that the drive element 134 may be translated along the mandrel 302 until positioned at a desired location. The drive element 134 may be secured to the mandrel 302 by various means or devices. In some embodiments, for example, drive element 134 may be coupled directly to the outer surface of the mandrel 302, such as by using one or more mechanical fasteners (e.g., screws, bolts, snap rings, pins, etc.), a threaded engagement (e.g., the central orifice 316 and the mandrel 302 may be threaded), or via a shrink or interference fit. In other embodiments, however, drive element 134 may be restrained between the wiper elements 130*a,b* (e.g., the insert 312) and the nose assembly 202 (e.g., the sealing section 206) and held in place by threading the threaded nut 314 to the mandrel 302 at the first end 304*a*.

Figure 4:
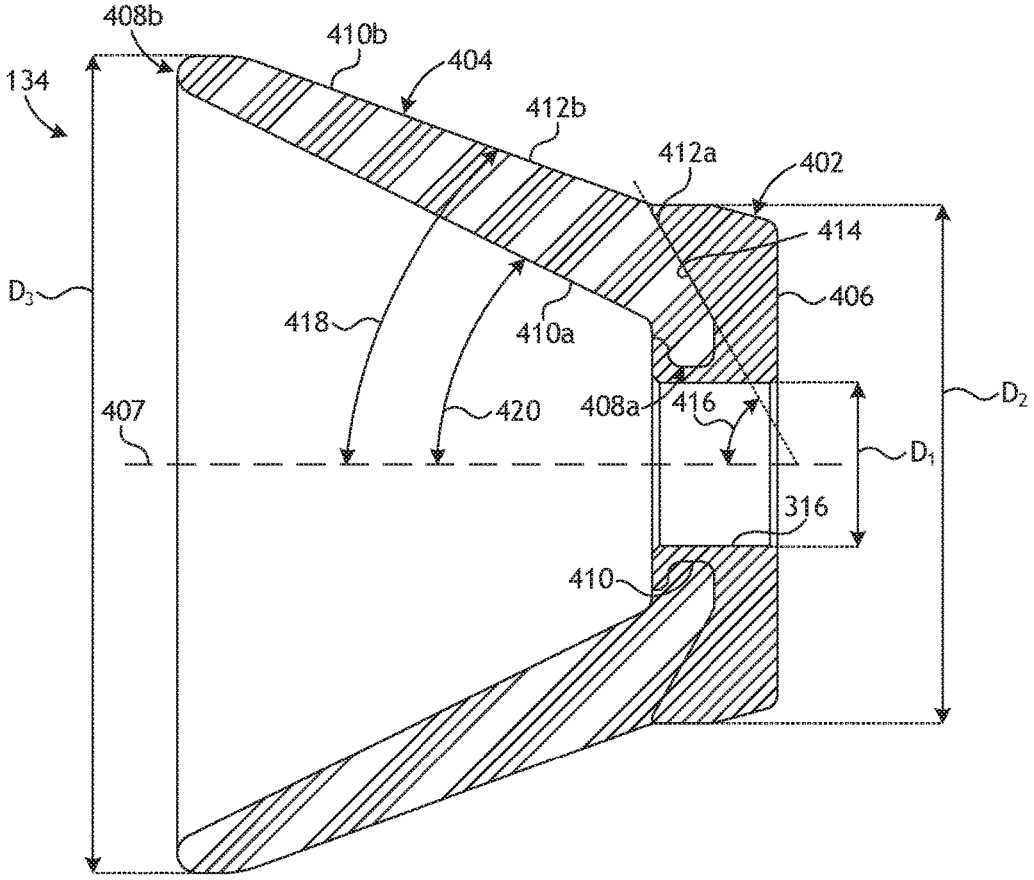
FIG. 4 is a cross-sectional side view of the drive element of FIGS. 2 and 3.

FIG. 4 is a cross-sectional side view of the drive element 134 of FIGS. 2 and 3, according to one or more embodiments. As illustrated, the drive element 134 may include a shoe 402 and a cup 404 coupled to and extending from the shoe 402. The shoe 402 comprises a generally annular body 406, preferably made of a millable material. Examples of suitable materials for the body 406 include, but are not limited to, a metal (e.g., aluminum, steel, brass, etc.), a plastic, a high-strength thermoplastic, a phenolic, a composite material, a glass, and any combination thereof. The central orifice 316 is defined axially through the body 406 along a longitudinal axis 407 of the drive element 134 and exhibits a diameter $D_1$ that is large enough to receive the mandrel 302 (FIG. 3). The body 406 exhibits a diameter $D_2$ that is small enough to allow the drive element 134 to pass through known reduced diameter restrictions that may be present downhole, but large enough to maximize the mechanical support of the cup 404.

The cup 404 may be made of a variety of pliable or flexible materials including, but not limited to, an elastomer, a thermoplastic, a thermoset, and polyurethane. Examples of suitable elastomers that may be used for the cup 404 include, for example, nitrile butadiene (NBR) which is a copolymer of acrylonitrile and butadiene, carboxylated acrylonitrile butadiene (XNBR), butyl rubber, nitrile rubber, hydrogenated nitrile butadiene rubber (HNBR—also referred to as hydrogenated acrylonitrile butadiene rubber or highly saturated nitrile), carboxylated hydrogenated acrylonitrile butadiene (XHNBR), hydrogenated carboxylated acrylonitrile butadiene (HXNBR), halogenated butyl rubbers, styrene-butadiene rubber, ethylene propylene rubber, ethylene propylene diene rubber, epichlorohydrin rubber, polyacrylic rubber, silicone rubber, fluorosilicone rubber, chloroprene rubber, polysulfide rubber, ethylene propylene (EPR), ethylene propylene diene (EPDM), tetrafluoroethylene and propylene (FEPM), fluorocarbon (FKM), perfluoroelastomer (FEKM), natural polyisoprene, synthetic polyisoprene, polybutadiene, polychloroprene, neoprene, baypren, fluoroelastomers, perfluoroelastomers, polyether block amides, chlorosulfonated polyethylene, ethylene-vinyl acetate, thermoplastic elastomers, resilin, elastin, combinations thereof, and the like. Examples of suitable thermoplastics that may be used for the cup 404 include, for example, polyphenylene sulfide (PPS), polyetheretherketones (e.g., PEEK, PEK and PEKK), and polytetrafluoroethylene (PTFE). Examples of suitable thermosets that may be used for the cup 404 include, for example, epoxies and phenolics.

The cup 404 exhibits a generally frustoconical shape and provides a first or "leading" end 408*a* and a second or "trailing" end 408*b* opposite the leading end 408*a*. The cup 404 further provides an inner cup surface 410*a* and an outer cup surface 410*b*, where the inner cup surface generally defines the interior of the cup 404 and the outer cup surface 410*b* defines the exterior of the cup 404. The cup 404 is coupled to the shoe 406 at the leading end 408*a* and extends radially outward and rearwardly therefrom toward the trailing end 408*b*. Accordingly, similar to the wiper elements 130*a,b* (FIG. 3), the drive element 134 generally opens toward the trailing end 408*b*.

At least a portion of the leading end 408*a* may be received within a trough 410 defined in the shoe 406 and bonded thereto via one or more bonding techniques. In some embodiments, for instance, the trough 410 may be coated with a bonding agent and the shoe 406 may be subsequently placed in an injection-molding machine where the cup 404 is molded to the shoe 406. As the material of the cup 404 cures, the bonding agent simultaneously cures to provide a bonded interface between the material of the shoe 406 and the material of the cup 404.

In some embodiments, as illustrated, the outer cup surface 410*b* may be defined by a reinforced section 412*a* and an exposed section 412*b*. The reinforced section 412*a* may be configured to provide structural reinforcement to the cup 404 to enable the drive element 134 to assume and resist axial and radial loading on the cup 404. To accomplish this, the reinforced section 412*a* may be engaged against an end wall 414 provided by the shoe 406. The reinforced section 412*a* may or may not be bonded to the end wall 414.

The end wall 414 extends radially from the trough 410 at an angle 416 offset from the longitudinal axis 407. In some embodiments, the angle 416 may be 90° (i.e., a vertical end wall 414). In other embodiments, however, and to allow the end wall 414 to provide an amount of radial support to the cup 404, the angle 416 may range between about 60° and about 75° offset from the longitudinal axis 407. In such embodiments, the end wall 414 applies a normal force on the cup 404, which helps prevent the cup 404 from expanding radially outward during operation. The angle 416, however, may alternatively be provided at any angle ranging between 1° and 90°, without departing from the scope of the disclosure. As will be appreciated, with an angled end wall 414, the shoe 402 helps reduce flexibility of the cup 404 so that the drive element 134 can achieve the pressure differential required to propel the wiper dart 128 (FIGS. 2-3) through the reduced diameter restrictions.

The exposed section 412*b* transitions from the reinforced section 412*a* and extends at an angle 418 offset from the longitudinal axis 407. In some embodiments, the angles 416, 418 may be the same. In other embodiments, however, the angles 416, 418 may be dissimilar. The angle 418 may range between about 10° and about 45°, but is preferably less than 30° and greater than 0°.

The angle 418 of the outer cup surface 410*b* defines the angle of impingement for the cup 404 as the wiper dart 128 (FIGS. 2-3) moves downhole. The angle 418 may be designed such that a maximum outer diameter $D_3$ of the drive element 134 is less than or equal to the maximum outer diameter of any of the wiper elements 130*a,b* (FIGS. 2-3). Accordingly, the angle of impingement for the drive element 134 may be less than the respective angles of impingement of the wiper elements 130*a,b*. As will be appreciated, a lower angle 418 will allow the wiper dart 128 (FIGS. 2-3) to more easily pass through the reduced diameter restrictions. Moreover, a lower angle 418 will also make the cup 404 less susceptible to inverting, which translates into providing the drive element 134 with a higher differential pressure capability during operation.

It should be noted, however, that embodiments are also contemplated herein where the maximum outer diameter $D_3$ of the drive element 134 is greater than at least one of the wiper elements 130*a,b* (FIGS. 2-3), without departing from the scope of the disclosure. In such embodiments, the structural support of the shoe 402 still serves its purpose in reducing the flexibility of the cup 404, which enables the drive element 134 to achieve the pressure differential required to propel the wiper dart 128 (FIGS. 2-3) through the reduced diameter restrictions.

The inner cup surface 410*a* extends at an angle 420 offset from the longitudinal axis 407. In some embodiments, the angles 418, 420 may be the same. In other embodiments, however, the angles 418, 420 may be dissimilar. The angle 420 may range between about 10° and about 45°, but is preferably less than 30° and greater than 0°. In at least one embodiment, the angle 420 of the inner cup surface 410*a* may be greater than the angle 418 of the outer cup surface 410*b*. This results in a more firm cup 404 that tapers to a thinner cup 404 dimension from the leading end 408*a* toward the trailing end 408*b*.

To facilitate a better understanding of the present disclosure, the following example of a representative embodiment is given. In no way should the following example be read to limit or define the scope of the disclosure.

The above-described wiper dart 128 may be introduced into the work string 120 and conveyed downhole. The drive element 134 may be specifically designed for the minimum and most severe restrictions in the work string 120. Commonly, multiple pipe (tubular) sizes are used within the same work string. Consequently, the work string 120 in this example includes one or more 6⅝" pipes, one or more 5½" pipes, and one or more 5" pipes. There are typically two diameters per pipe size due to the internal upset of each connection and, therefore, these pipe sizes may exhibit inner diameters of 6.065", 5.187", 4.670", 3.500", 4.276", and 3.687".

Not only does the wiper dart 128 have to effectively seal and wipe each of these minimum diameters, it must also successfully pass through the minimum restriction of various downhole tools, such as a cement head, safety valves, a crossover tool, diverter tools, liner hangers, liner plug assemblies, and other conventional wellbore cementing tools. The minimum restrictions of such downhole tools can be less than 2" in some cases.

In the present example, the diameter $D_2$ (FIG. 4) of the body 406 (FIG. 4) of the shoe 402 (FIG. 4) may be 2.220". As a result, the minimum restriction for which the wiper dart 128 is designed is 2.250" due to the hard shoulder of the shoe 402. Testing undertaken by the inventors has showed that the drive element 134 is able to withstand more than 1,000 psi in a 2.50 inner diameter reduced diameter restriction. This is possible due, in part, to the angle 418 (FIG. 4) of the outer cup surface 410*b* (FIG. 4), which was about 20°, and the rigid mechanical support of the shoe 402 at the end wall 414 (FIG. 4). As will be appreciated, a shallow angle 418 may prove advantageous in leveraging trigonometric principles (i.e., the shallower the angle 418 relative to the longitudinal axis 407, the ratio of applied pressure directed radially will increase), which results in a greater effective radial seal. The greater effective radial seal may enable an increased axial force on the effective piston diameter in order to overcome drag that can result from interference between the outer diameter of the wiper elements 130*a,b* and the inner diameter of the restriction.

Accordingly, the drive element 134 may prove advantageous in combining the differential pressure capacity and rigid mechanical support of a packer cup, for example, with the flexibility of conventional wiper elements 130*a,b*. Whereas conventional wiper elements 130*a,b* exhibit a 50-100 psi differential pressure capacity, the presently disclosed embodiments of the drive element 134 may exhibit a differential pressure capacity of 1000 psi or more.

Embodiments disclosed herein include:

A. A wiper dart that includes one or more wiper elements disposed about a mandrel, each wiper element comprising a wiper cup that extends radially outward and rearwardly relative to the mandrel, a nose assembly coupled to the mandrel, and a drive element disposed about the mandrel and including a shoe and a cup coupled to the shoe, wherein the cup extends radially outward and rearwardly from the shoe and exhibits a maximum diameter less than or equal to a maximum diameter of the one or more wiper elements, and wherein the shoe provides at least one of axial and radial support to the cup.

B. A well system that includes a work string extended within a wellbore and coupled to a wellbore liner, and a wiper dart conveyed into the work string to hydraulically force a fluid through the work string and into the wellbore liner, the wiper dart including one or more wiper elements disposed about a mandrel and each comprising a wiper cup that extends radially outward and rearwardly relative to the mandrel to sealingly engage an inner wall of the work string, a nose assembly coupled to the mandrel, and a drive element disposed about the mandrel and including a shoe and a cup coupled to the shoe, wherein the cup extends radially outward and rearwardly from the shoe and exhibits a maximum diameter less than or equal to a maximum diameter of the one or more wiper elements, and wherein the shoe provides at least one of axial and radial support to the cup.

C. A method that includes pumping a fluid into a work string extended within a wellbore and coupled to a wellbore liner, pumping a wiper dart into the work string, the wiper dart including one or more wiper elements disposed about a mandrel, a nose assembly coupled to the mandrel, and a drive element disposed about the mandrel and including a shoe and a cup coupled to the shoe, wherein the cup exhibits a maximum diameter less than or equal to a maximum diameter of the one or more wiper elements, engaging an inner wall of the work string with the one or more sealing elements as the wiper dart advances downhole and thereby hydraulically forcing the fluid into the wellbore liner, propelling the wiper dart through a reduced diameter section defined in the work string with the drive element, and providing at least one of axial and radial support to the cup with the shoe as the wiper drive element propels the wiper dart through the reduced diameter section.

Each of embodiments A, B, and C may have one or more of the following additional elements in any combination: Element 1: wherein the drive element axially interposes the one or more wiper elements and the nose assembly. Element 2: further comprising a central orifice defined axially through the shoe to receive the mandrel. Element 3: wherein the cup comprises a flexible material selected from the group consisting of an elastomer, a thermoplastic, a thermoset, polyurethane, and any combination thereof. Element 4: wherein the shoe comprises a material selected from the group consisting of a metal, a plastic, a high-strength thermoplastic, a phenolic, a composite material, a glass, and any combination thereof. Element 5: wherein the shoe defines a trough and the cup is bonded to the shoe at the trough. Element 6: wherein the cup provides an inner cup surface and an outer cup surface and wherein the outer cup surface provides a reinforced section that engages an end wall defined by the shoe. Element 7: wherein the end wall extends at an angle offset from a longitudinal axis of the drive element and less than 90° to provide radial support to the cup. Element 8: wherein the cup provides an inner cup surface that extends at a first angle relative to a longitudinal axis of the drive element and an outer cup surface that extends at a second angle relative to the longitudinal axis and dissimilar to the first angle.

Element 9: wherein a portion of the wellbore is lined with casing and the wellbore liner comprises a liner coupled to and extending from the casing. Element 10: further comprising a downhole tool releasably coupled to a lower end of the work string to receive the wiper dart. Element 11: wherein the drive element interposes the one or more wiper elements and the nose assembly. Element 12: wherein the shoe defines a trough and the cup is bonded to the shoe at the trough. Element 13: wherein the cup provides an inner cup surface and an outer cup surface and wherein the outer cup surface provides a reinforced section that engages an end wall defined by the shoe. Element 14: wherein the end wall extends at an angle offset from a longitudinal axis of the drive element and less than 90° to provide radial support to the cup.

Element 15: wherein the shoe defines a trough and the cup is bonded to the shoe at the trough, the method further comprising providing axial support to the cup with the cup bonded to the shoe at the trough. Element 16: wherein the cup provides an inner cup surface and an outer cup surface and the outer cup surface provides a reinforced section, the method further comprising providing axial support to the cup by engaging the reinforced section against an end wall defined by the shoe. Element 17: wherein the end wall extends at an angle offset from a longitudinal axis of the drive element and less than 90°, the method further comprising providing radial support to the cup by engaging the reinforced section against an end wall defined by the shoe.

By way of non-limiting example, exemplary combinations applicable to A, B, and C include: Element 6 with Element 7; Element 13 with Element 14; and Element 16 with Element 17.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A wiper dart, comprising:

one or more wiper elements disposed about a mandrel, each wiper element comprising a wiper cup that extends radially outward and rearwardly relative to the mandrel;

a nose assembly coupled to the mandrel; and a drive element disposed about the mandrel and including a shoe and a cup coupled to the shoe, wherein the cup of the drive element extends radially outward and rearwardly from the shoe and exhibits a maximum diameter less than or equal to a maximum diameter of the one or more wiper elements, wherein the shoe provides at least one of axial and radial support to the cup, wherein the cup of the drive element provides an inner cup surface and an outer cup surface, wherein the outer cup surface provides a reinforced section that engages an end wall defined by the shoe, and wherein the end wall extends at a first angle offset from a longitudinal axis of the drive, the first angle ranging between 1° and 90° to provide radial support to the cup of the drive element.

2. The wiper dart of claim 1, wherein the drive element axially interposes the one or more wiper elements and the nose assembly.

3. The wiper dart of claim 1, further comprising a central orifice defined axially through the shoe to receive the mandrel.

4. The wiper dart of claim 1, wherein the cup of the drive element comprises a flexible material selected from the group consisting of an elastomer, a thermoplastic, a thermoset, polyurethane, and any combination thereof.

5. The wiper dart of claim 1, wherein the shoe comprises a material selected from the group consisting of a metal, a plastic, a high-strength thermoplastic, a phenolic, a composite material, a glass, and any combination thereof.

6. The wiper dart of claim 1, wherein the shoe defines a trough and the cup of the drive element is bonded to the shoe at the trough.

7. The wiper dart of claim 6, further comprising a central orifice defined axially through the shoe to receive the mandrel.

8. The wiper dart of claim 1, wherein the outer cup surface further comprises an exposed section adjacent the reinforced section, wherein the exposed section of the outer cup surface extends at a second angle offset from the longitudinal axis of the drive, the second angle ranging between 10° and 45°.

9. The wiper dart of claim 1, wherein the cup of the drive element provides an inner cup surface that extends at a first angle relative to a longitudinal axis of the drive element and an outer cup surface that extends at a second angle relative to the longitudinal axis and dissimilar to the first angle.

10. A well system, comprising:

a work string extended within a wellbore and coupled to a wellbore liner; and a wiper dart conveyed into the work string to hydraulically force a fluid through the work string and into the wellbore liner, the wiper dart including:

one or more wiper elements disposed about a mandrel and each comprising a wiper cup that extends radially outward and rearwardly relative to the mandrel to sealingly engage an inner wall of the work string;

a nose assembly coupled to the mandrel; and a drive element disposed about the mandrel and including a shoe and a cup coupled to the shoe, wherein the cup of the drive element extends radially outward and rearwardly from the shoe and exhibits a maximum diameter less than or equal to a maximum diameter of the one or more wiper elements, and wherein the shoe provides at least one of axial and radial support to the cup, wherein the cup of the drive element provides an inner cup surface and an outer cup surface, wherein the outer cup surface provides a reinforced section that engages an end wall defined by the shoe, and wherein the end wall extends at a first angle offset from a longitudinal axis of the drive, the first angle ranging between 1° and 90° to provide radial support to the cup of the drive element.

11. The well system of claim 10, wherein a portion of the wellbore is lined with casing and the wellbore liner comprises a liner coupled to and extending from the casing.

12. The well system of claim 10, further comprising a downhole tool releasably coupled to a lower end of the work string to receive the wiper dart.

13. The well system of claim 10, wherein the drive element interposes the one or more wiper elements and the nose assembly.

14. The well system of claim 10, wherein the shoe defines a trough and the cup of the drive element is bonded to the shoe at the trough.

15. The well system of claim 14, wherein the wiper dart further comprises a central orifice defined axially through the shoe to receive the mandrel.

16. The well system of claim 10, wherein the outer cup surface further comprises an exposed section adjacent the reinforced section, wherein the exposed section of the outer cup surface extends at a second angle offset from the longitudinal axis of the drive, the first angle ranging between 10° and 45°.

17. A method, comprising:

pumping a fluid into a work string extended within a wellbore and coupled to a wellbore liner;

pumping a wiper dart into the work string, the wiper dart including one or more wiper elements disposed about a mandrel, a nose assembly coupled to the mandrel, and a drive element disposed about the mandrel and including a shoe and a cup coupled to the shoe, wherein the cup exhibits a maximum diameter less than or equal to a maximum diameter of the one or more wiper elements, wherein the cup of the drive element provides an inner cup surface and an outer cup surface, wherein the outer cup surface provides a reinforced section that engages an end wall defined by the shoe, and wherein the end wall extends at an angle offset from a longitudinal axis of the drive, the angle ranging between 1° and 90° to provide radial support to the cup of the drive element;

engaging an inner wall of the work string with the one or more sealing elements as the wiper dart advances downhole and thereby hydraulically forcing the fluid into the wellbore liner;

propelling the wiper dart through a reduced diameter section defined in the work string with the drive element; and providing at least one of axial and radial support to the cup with the shoe as the wiper drive element propels the wiper dart through the reduced diameter section.

18. The method of claim 17, wherein the shoe defines a trough and the cup is bonded to the shoe at the trough, the method further comprising providing axial support to the cup with the cup bonded to the shoe at the trough.

19. The method of claim 18, wherein the wiper dart further comprises a central orifice defined axially through the shoe to receive the mandrel.

20. The method of claim 17, the method further comprising providing axial and radial support to the cup by engaging the reinforced section against the end wall defined by the shoe.

* * * * *